US009938040B2

(12) United States Patent
Buscema

(10) Patent No.: US 9,938,040 B2
(45) Date of Patent: Apr. 10, 2018

(54) BLANKS AND METHODS FOR FORMING A SHELF-READY DISPLAY CONTAINER

(71) Applicant: WestRock Shared Services, LLC, Norcross, GA (US)

(72) Inventor: Craig W. Buscema, Douglasville, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 15/073,169

(22) Filed: Mar. 17, 2016

(65) Prior Publication Data

US 2017/0267399 A1 Sep. 21, 2017

(51) Int. Cl.

| | |
|---|---|
| ***B65D 5/54*** | (2006.01) |
| ***B65D 5/02*** | (2006.01) |
| ***B65D 5/468*** | (2006.01) |
| ***B31B 1/26*** | (2006.01) |
| ***B31B 1/60*** | (2006.01) |
| ***B31B 1/90*** | (2006.01) |
| ***B31B 3/26*** | (2006.01) |

(Continued)

(52) U.S. Cl.

CPC ..... *B65D 5/5445* (2013.01); *B31B 1/26* (2013.01); *B31B 1/60* (2013.01); *B31B 1/90* (2013.01); *B31B 3/26* (2013.01); *B31B 3/60* (2013.01); *B31B 3/74* (2013.01); *B65D 5/02* (2013.01); *B65D 5/4608* (2013.01); *B31B 2201/26* (2013.01); *B31B 2201/6091* (2013.01); *B31B 2201/90* (2013.01); *B31B 2203/10* (2013.01)

(58) Field of Classification Search

CPC ..... B65D 5/5445; B65D 5/4608; B65D 5/02

USPC ..... 206/774, 736

See application file for complete search history.

(56) References Cited

U.S. PATENT DOCUMENTS

| | | | |
|---|---|---|---|
| 1,431,133 | A | 10/1922 | Young |
| 1,770,618 | A | 7/1930 | Lambert |
| 1,803,966 | A | 5/1931 | Gibbons |

(Continued)

FOREIGN PATENT DOCUMENTS

| | | | |
|---|---|---|---|
| DE | 2116726 | A | 10/1972 |
| DE | 9005410 | U1 | 7/1990 |

(Continued)

OTHER PUBLICATIONS

Delcor Cabrio Advertisment, apparently before Sep. 15, 2015. Downloaded Aug. 10, 2016 from http://www.delkorsystems.com/ameristar-award-winner.

*Primary Examiner* — Steven A. Reynolds

(74) *Attorney, Agent, or Firm* — WestRock IP Legal

(57) ABSTRACT

A blank of sheet material for forming a container includes a front panel, a top panel, a rear panel, and a bottom panel coupled together in series by a plurality of generally parallel fold lines. The blank also includes a pair of front side panels extending from opposing side edges of the front panel, a pair of top side panels coupled to opposing side edges of the top panel, and a pair of bottom side panels coupled to opposing side edges of the bottom panel. A side tab extends from each bottom side panel along a tab perforation line. Each side tab is configured to couple to one of the front side panels in a face-to-face relationship. A face of each of the top panel, the bottom panel, the pair of top side panels, and the pair of bottom side panels is devoid of perforation lines extending therethrough.

12 Claims, 6 Drawing Sheets

(51) Int. Cl.
*B31B 3/60* (2006.01)
*B31B 3/74* (2006.01)

(56) References Cited

U.S. PATENT DOCUMENTS 1,916,045 A 6/1933 Freymann
1,925,102 A 9/1933 Levkoff
1,932,429 A 10/1933 Wellman
1,986,101 A 1/1935 Brodsky
2,074,229 A 3/1937 Mckee
2,343,222 A 2/1944 Nelson
2,426,911 A 9/1947 Williamson
2,540,595 A 2/1951 Props
2,675,913 A 4/1954 Hanson
2,706,593 A 4/1955 Caraher
2,762,550 A 9/1956 Goettsch
2,808,190 A 10/1957 Buhrmaster
2,836,338 A 5/1958 Daniels
2,964,169 A 12/1960 Brachman
3,007,622 A 11/1961 George
3,019,959 A 2/1962 Skowronski
3,029,008 A 4/1962 Membrino
3,043,490 A 7/1962 Burnett
3,055,573 A 9/1962 Carter
3,069,062 A 12/1962 Keith
3,111,255 A 11/1963 Skowronski
3,118,587 A 1/1964 Welshenbach
3,157,345 A 11/1964 George
3,167,179 A 1/1965 Goldstein
3,227,266 A 1/1966 Soma
3,228,582 A 1/1966 Osberg
3,235,166 A 2/1966 Guyer
3,245,527 A 4/1966 Martin
3,254,758 A 6/1966 Guyer
3,276,667 A 10/1966 Johnson
3,285,492 A 11/1966 Demboske
3,310,221 A 3/1967 Duncan
3,310,223 A 3/1967 Buttery
3,314,587 A 4/1967 Johnson
3,371,844 A 3/1968 Perrella
3,392,905 A 7/1968 Caldwell
3,428,234 A 2/1969 DuBarry
3,476,023 A 11/1969 Fuller
3,523,636 A 8/1970 Phillips
3,531,045 A 9/1970 Johnson
3,542,192 A 11/1970 Steck
3,543,998 A 12/1970 Dunlap
3,561,669 A 2/1971 Postweiler
3,568,911 A 3/1971 Bebout
3,606,969 A 9/1971 Voytko
3,640,190 A 2/1972 Fuller
3,643,856 A 2/1972 Jones
3,664,494 A 5/1972 Mergens
3,669,251 A 6/1972 Phillips
3,721,381 A 3/1973 Locke
3,730,417 A 5/1973 Lawson
3,744,702 A 7/1973 Ellison
3,815,808 A 6/1974 Bunnell
3,884,348 A 5/1975 Ross
3,893,614 A 7/1975 Meyers
3,910,482 A 10/1975 Bamburg et al.
3,910,483 A 10/1975 Ritter
3,917,158 A 11/1975 Dorofachuk et al.
3,926,362 A 12/1975 Beck et al.
3,927,761 A 12/1975 Boyle
3,935,798 A 2/1976 Paxton
3,942,631 A 3/1976 Sutherland et al.
3,955,671 A 5/1976 Ockey
3,955,743 A 5/1976 Tanneberger
3,960,312 A 6/1976 Gorham
3,961,706 A 6/1976 Roccaforte et al.
3,967,774 A 7/1976 Quemer
4,000,811 A 1/1977 Hardison et al.
4,020,946 A 5/1977 Gardner et al.
4,058,206 A 11/1977 Morse et al.
4,103,819 A 8/1978 Muise
4,113,100 A 9/1978 Soja et al.
4,133,474 A 1/1979 Hall
4,174,803 A 11/1979 Shrontz et al.
4,184,625 A 1/1980 Stollberg et al.
4,196,843 A 4/1980 Garmon
4,211,322 A 7/1980 Crescenzi et al.
4,217,984 A 8/1980 Magnuson
4,350,281 A 9/1982 Dornbusch et al.
4,363,400 A 12/1982 Lewis
4,396,144 A 8/1983 Gutierrez et al.
4,429,826 A 2/1984 Shedd
4,483,095 A 11/1984 Webinger
4,553,666 A 11/1985 Gullikson
4,558,785 A 12/1985 Gordon
4,565,316 A 1/1986 Jes
4,641,746 A 2/1987 Dornbusch et al.
4,784,271 A 11/1988 Wosaba et al.
4,848,651 A 7/1989 Hartness
4,869,424 A 9/1989 Wood
4,871,067 A 10/1989 Valenti
4,886,160 A 12/1989 Kligerman
4,946,042 A 8/1990 Ferreri et al.
5,016,753 A 5/1991 Henderson
5,076,491 A 12/1991 Freudentahl et al.
5,098,757 A 3/1992 Steel
5,137,211 A 8/1992 Summer et al.
5,154,309 A 10/1992 Wischusen et al.
5,167,324 A 12/1992 Miller
5,181,650 A 1/1993 Hollander et al.
5,195,677 A 3/1993 Quintana et al.
5,201,868 A 4/1993 Johnson
5,288,012 A 2/1994 Demay
5,348,147 A 9/1994 Gottfreid
5,350,111 A 9/1994 Vosbikian
5,368,194 A 11/1994 Oliff et al.
5,413,276 A 5/1995 Sheffer
5,415,343 A 5/1995 Vosbikian
5,417,342 A 5/1995 Hutchison
5,465,831 A 11/1995 Smith
5,489,023 A 2/1996 Havlovitz
5,505,368 A 4/1996 Kanter et al.
5,505,369 A 4/1996 Taliaferro
5,505,371 A 4/1996 O'neill
5,507,430 A 4/1996 Imhoff
5,560,692 A 10/1996 Smith
5,582,345 A 12/1996 Lankhuijzen
5,590,788 A 1/1997 Inman
5,622,309 A 4/1997 Matsuda et al.
5,651,497 A 7/1997 Ventura et al.
5,657,872 A 8/1997 Leftwich et al.
5,690,213 A 11/1997 Matsumura
5,697,548 A 12/1997 Halsell
5,715,993 A 2/1998 Pareike
5,730,296 A 3/1998 Limmer
5,826,728 A 10/1998 Sheffer
5,842,576 A 12/1998 Snow
5,881,884 A 3/1999 Podosek
5,918,801 A 7/1999 Milio
5,921,398 A * 7/1999 Carroll ..... B65D 5/5253 206/736
5,950,914 A 9/1999 Dunton et al.
5,957,294 A 9/1999 Kanter
5,975,413 A 11/1999 Moen
5,979,749 A 11/1999 Bozich
6,073,833 A 6/2000 Desrosiers et al.
6,129,211 A 10/2000 Prakken et al.
6,158,579 A 12/2000 Rosenbaum
6,168,027 B1 1/2001 Esser
6,189,778 B1 2/2001 Kanter
6,189,780 B1 2/2001 Kanter
6,209,786 B1 4/2001 Yelton et al.
6,357,654 B1 3/2002 Gardner et al.
6,371,365 B1 4/2002 Doucette et al.
6,386,369 B2 5/2002 Yuhas et al.
6,402,021 B1 * 6/2002 Heathcock ..... B65D 5/5445 229/117.16
6,405,921 B1 6/2002 Cochrane
6,409,077 B1 6/2002 Telesca et al.

(56) References Cited

U.S. PATENT DOCUMENTS

| | | | | |
|---|---|---|---|---|
| 6,435,351 | B1 | 8/2002 | Gibb | |
| 6,457,637 | B1 | 10/2002 | Fritz et al. | |
| 6,478,159 | B1 | 11/2002 | Taylor et al. | |
| 6,510,982 | B2 | 1/2003 | White et al. | |
| 6,554,135 | B1 | 4/2003 | Luceri et al. | |
| 6,557,708 | B2 | 5/2003 | Polacco | |
| 6,729,475 | B2 | 5/2004 | Yuhas et al. | |
| 6,755,306 | B2 | 6/2004 | Maus | |
| 6,793,070 | B2 | 9/2004 | Dye | |
| 6,832,683 | B2 | 12/2004 | Boriani et al. | |
| D503,614 | S | 4/2005 | Sax et al. | |
| 6,918,487 | B2 | 7/2005 | Harrelson | |
| 6,932,265 | B2 | 8/2005 | Sax et al. | |
| 6,948,617 | B2 | 9/2005 | Kanter et al. | |
| 6,974,033 | B2 | 12/2005 | McLeod et al. | |
| 6,976,588 | B2 | 12/2005 | Wischusen et al. | |
| 6,981,632 | B2 * | 1/2006 | Gardner | B65D 5/541 229/103.3 |
| 6,986,456 | B2 | 1/2006 | Jone | |
| 7,066,321 | B2 | 6/2006 | Kawaguchi et al. | |
| 7,066,333 | B2 | 6/2006 | Justice | |
| 7,066,379 | B2 * | 6/2006 | McLeod | B65D 5/321 229/120.24 |
| 7,080,736 | B2 | 7/2006 | Jackson et al. | |
| 7,097,041 | B2 | 8/2006 | Marrale | |
| 7,104,435 | B2 | 9/2006 | Holley | |
| 7,175,066 | B2 | 2/2007 | Varanasi | |
| 7,213,707 | B2 | 5/2007 | Hubbs et al. | |
| 7,225,930 | B2 | 6/2007 | Ford et al. | |
| 7,237,674 | B2 | 7/2007 | Auclair | |
| 7,284,652 | B2 | 10/2007 | Zeitler et al. | |
| 7,284,662 | B2 | 10/2007 | Debusk et al. | |
| 7,331,508 | B2 | 2/2008 | Kanter et al. | |
| 7,373,765 | B2 | 5/2008 | Welchel et al. | |
| 7,377,385 | B2 | 5/2008 | Giannini et al. | |
| 7,401,711 | B2 | 7/2008 | Spivey | |
| 7,431,163 | B2 | 10/2008 | Andersen | |
| 7,451,878 | B2 | 11/2008 | Rochefort et al. | |
| 7,455,215 | B2 | 11/2008 | McLeod et al. | |
| 7,478,725 | B2 | 1/2009 | Holley | |
| 7,523,842 | B2 | 4/2009 | Spivey | |
| 7,568,611 | B2 | 8/2009 | Cargile | |
| 7,621,438 | B2 | 11/2009 | Spivey | |
| 7,628,746 | B2 | 12/2009 | Varanasi | |
| 7,703,666 | B2 | 4/2010 | Hand et al. | |
| 7,717,324 | B2 | 5/2010 | Keefe | |
| 7,743,921 | B2 | 6/2010 | Hubbs et al. | |
| 7,870,994 | B2 | 1/2011 | Spivey et al. | |
| 7,992,716 | B2 | 8/2011 | Jackson | |
| 8,011,567 | B2 | 9/2011 | Debusk et al. | |
| 8,028,839 | B2 | 10/2011 | Learn | |
| 8,061,587 | B2 | 11/2011 | Blin | |
| 8,342,335 | B2 * | 1/2013 | Couture | B65D 5/5445 206/746 |
| 8,376,141 | B2 | 2/2013 | Couture | |
| 8,596,460 | B2 | 12/2013 | Scatterday | |
| 8,789,703 | B2 | 7/2014 | Couture et al. | |
| 8,833,638 | B2 | 9/2014 | Pezzoli | |
| 9,073,682 | B2 * | 7/2015 | DeBusk | B65D 71/36 |
| 2002/0175106 | A1 | 11/2002 | Nemoto | |
| 2004/0074956 | A1 | 4/2004 | Sax et al. | |
| 2004/0084350 | A1 | 5/2004 | Kim | |
| 2004/0232038 | A1 | 11/2004 | Daniels | |
| 2004/0232039 | A1 | 11/2004 | Daniels | |
| 2005/0000853 | A1 | 1/2005 | Rochefort et al. | |
| 2005/0161496 | A1 | 7/2005 | McLeod et al. | |
| 2005/0184139 | A1 | 8/2005 | Gasior | |
| 2005/0263434 | A1 | 12/2005 | Tibbels | |
| 2006/0006096 | A1 | 1/2006 | Funk | |
| 2006/0054676 | A1 | 3/2006 | Wischusen | |
| 2006/0060643 | A1 | 3/2006 | Sheffer | |
| 2006/0261140 | A1 | 11/2006 | Holley | |
| 2006/0283927 | A1 | 12/2006 | Walsh et al. | |
| 2007/0131749 | A1 | 6/2007 | Coltri-Johnson et al. | |
| 2007/0221715 | A1 | 9/2007 | Tibbels et al. | |
| 2007/0278282 | A1 | 12/2007 | Jolley et al. | |
| 2008/0078691 | A1 | 4/2008 | Malik et al. | |
| 2008/0197182 | A1 | 8/2008 | Jackson | |
| 2008/0245650 | A1 | 10/2008 | Kramlich | |
| 2008/0245850 | A1 | 10/2008 | Spivey | |
| 2009/0014352 | A1 * | 1/2009 | Foden | B65D 5/5445 206/746 |
| 2010/0276333 | A1 | 11/2010 | Couture | |
| 2011/0049226 | A1 | 3/2011 | Moreau et al. | |
| 2011/0284621 | A1 | 11/2011 | Couture | |
| 2011/0284624 | A1 | 11/2011 | Debusk et al. | |
| 2012/0234724 | A1 | 9/2012 | James et al. | |
| 2013/0092596 | A1 | 4/2013 | Couture et al. | |
| 2015/0053587 | A1 | 2/2015 | Gessler et al. | |

FOREIGN PATENT DOCUMENTS

| | | | |
|---|---|---|---|
| DE | 9105890 | U1 | 8/1991 |
| DE | 9210565 | U1 | 11/1992 |
| DE | 4325134 | A1 | 2/1994 |
| EP | 0456896 | A1 | 11/1991 |
| FR | 2383838 | A1 | 10/1978 |
| GB | 1068191 | A | 5/1967 |
| WO | WO1995011165 | A1 | 4/1995 |

* cited by examiner

BLANKS AND METHODS FOR FORMING A SHELF-READY DISPLAY CONTAINER

BACKGROUND

The embodiments described herein relate generally to a blank for forming a container and, more particularly, to a blank for forming a convertible shipping container having a removable top portion and a tray portion, wherein the container is convertible into a display tray when the top portion is removed from the tray portion.

Containers fabricated from paperboard and/or corrugated paperboard material are often used to store and transport goods. Such containers are usually formed from blanks of sheet material that are folded along a plurality of preformed fold lines to form an erected corrugated container. At least some known blanks include a pair of side panels, a top panel, a bottom panel, a plurality of end panels, and, in some cases, a glue tab, connected by a plurality of fold lines. The panels are rotated to form end walls, side walls, a bottom wall, and a top wall of the container. To form at least some known containers, some of the panels are secured using an adhesive. Such known containers are formed using a machine and/or by hand.

At least some known containers that are used to transport and/or store products may be stacked one on the other when the products are being transported or stored. The side walls of the containers on the lower layers of the stack are configured to support a weight of the containers on the upper layers of the stack. In addition, at least some known containers include lines of weakness through at least one side wall to facilitate separating a top portion of the container from a display (or tray) portion of the container after arrival at a retail facility. However, the lines of weakness in the side walls may reduce the stacking strength, causing products within the lower container to support the weight of the upper layers. As such, the products within the containers may be damaged during transport and/or storage.

BRIEF DESCRIPTION

In one aspect, a blank of sheet material for forming a container convertible from a shipping configuration to a display configuration is provided. The blank includes a front panel, a top panel, a rear panel, and a bottom panel coupled together in series by a plurality of generally parallel fold lines. The blank also includes a pair of front side panels extending from opposing side edges of the front panel, a pair of top side panels coupled to opposing side edges of the top panel, and a pair of bottom side panels coupled to opposing side edges of the bottom panel. A respective side tab extends from each bottom side panel along a respective tab perforation line. Each side tab is configured to couple to one of the front side panels in a face-to-face relationship when the container is formed. A face of each of the top panel, the bottom panel, the pair of top side panels, and the pair of bottom side panels is devoid of perforation lines extending therethrough.

In another aspect, a container convertible from a shipping configuration to a display configuration is provided. The container is formed from a blank. The container includes opposing front and rear walls, and opposing top and bottom walls perpendicular to the opposing front and rear walls. The container also includes a pair of opposing side walls orthogonal to the front and rear walls and the top and bottom walls. Each of the side walls includes a front side panel emanating from the front wall, a top side panel emanating at least indirectly from the top wall, a bottom side panel emanating at least indirectly from the bottom wall, and a side tab emanating from the bottom side panel along a tab perforation line. The side tab is coupled in a face-to-face relationship with the front side panel. A face of each of the top wall, the bottom wall, the top side panels, and the bottom side panels is devoid of perforation lines extending therethrough.

In yet another aspect, a method for forming a container from a blank is provided. The container is convertible from a shipping configuration to a display configuration. The method includes rotating a series of panels of the blank including a front panel, a top panel, a rear panel, and a bottom panel about a plurality of generally parallel fold lines to form a front wall, a top wall, a rear wall, and a bottom wall of the container. The method also includes forming a pair of opposing side walls. Forming the side walls includes rotating a pair of front side panels, a pair of top side panels, and a pair of bottom side panels into orthogonal relationship with the front wall, the top wall, the rear wall, and the bottom wall. The front side panels extend from opposing side edges of the front panel, the top side panels are coupled to opposing side edges of the top panel, and the bottom side panels are coupled to opposing side edges of the bottom panel. Forming the side walls also includes coupling each of the front side panels to a respective side tab in a face-to-face relationship. Each side tab extends from a respective one of the bottom side panels along a tab perforation line. A face of each of the top panel, the bottom panel, the pair of top side panels, and the pair of bottom side panels is devoid of perforation lines extending therethrough.

DETAILED DESCRIPTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The embodiments described herein provide a stackable, convertible shipping container formed from a blank, and a method for constructing the same. The blank is constructed from sheet material. The container may be constructed from sheet material using a machine and/or by hand. In one embodiment, the blank is fabricated from a corrugated cardboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

In an example embodiment, the container and/or a blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Further, different embodiments described herein can vary in size and/or dimensions although similar labels are used for each embodiment. For example, although a depth is labeled similarly throughout the description, each embodiment can have varying depths.

Figure 1:
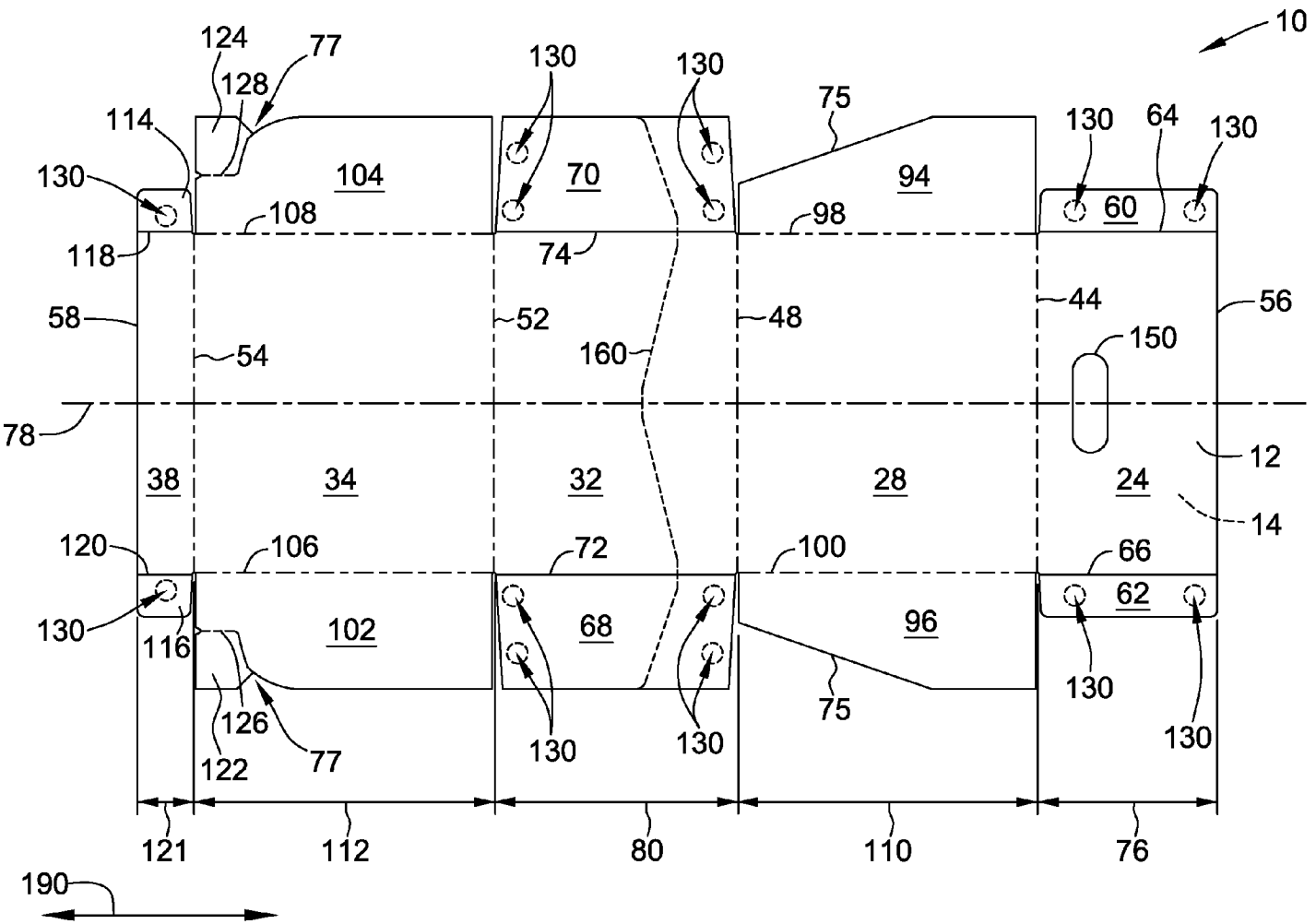
FIG. 1 is a top plan view of a first example embodiment of a blank of sheet material.
Figure 2:
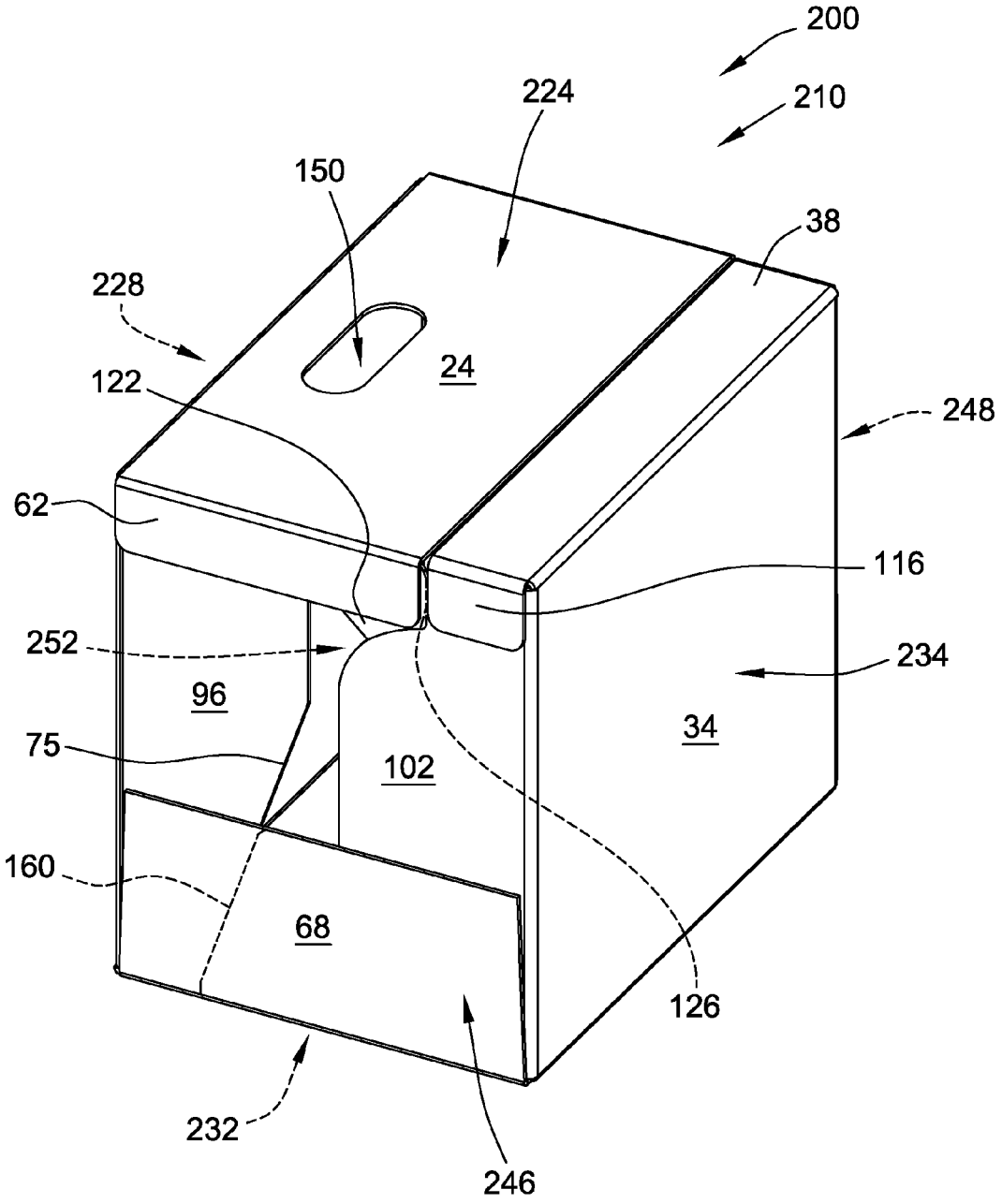
FIG. 2 is a perspective view of an example container formed from the blank shown in FIG. 1 in a closed, shipping configuration in a first orientation.
Figure 3:
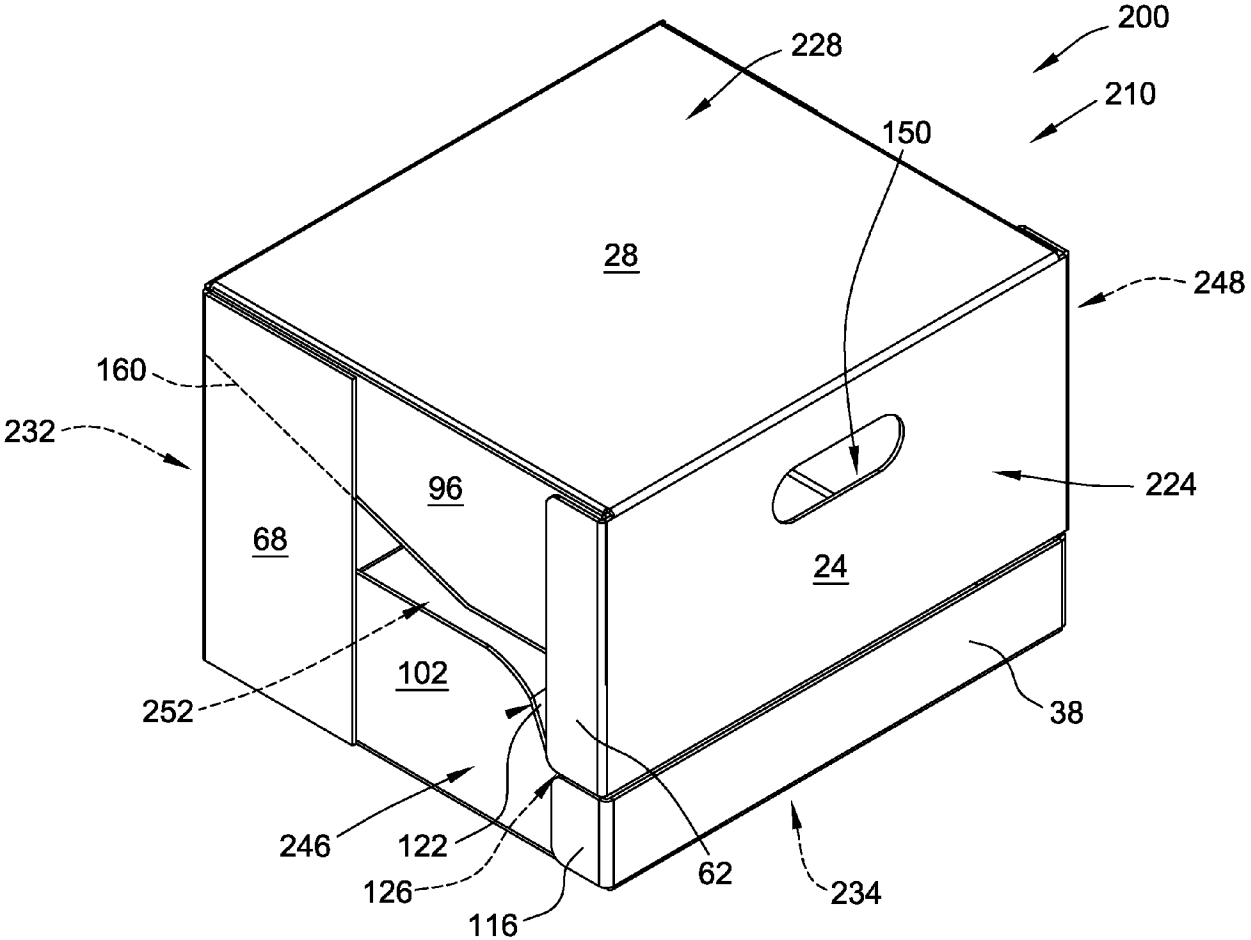
FIG. 3 is another perspective view of the container of FIG. 2 in a closed, shipping configuration in a second orientation.
Figure 4:
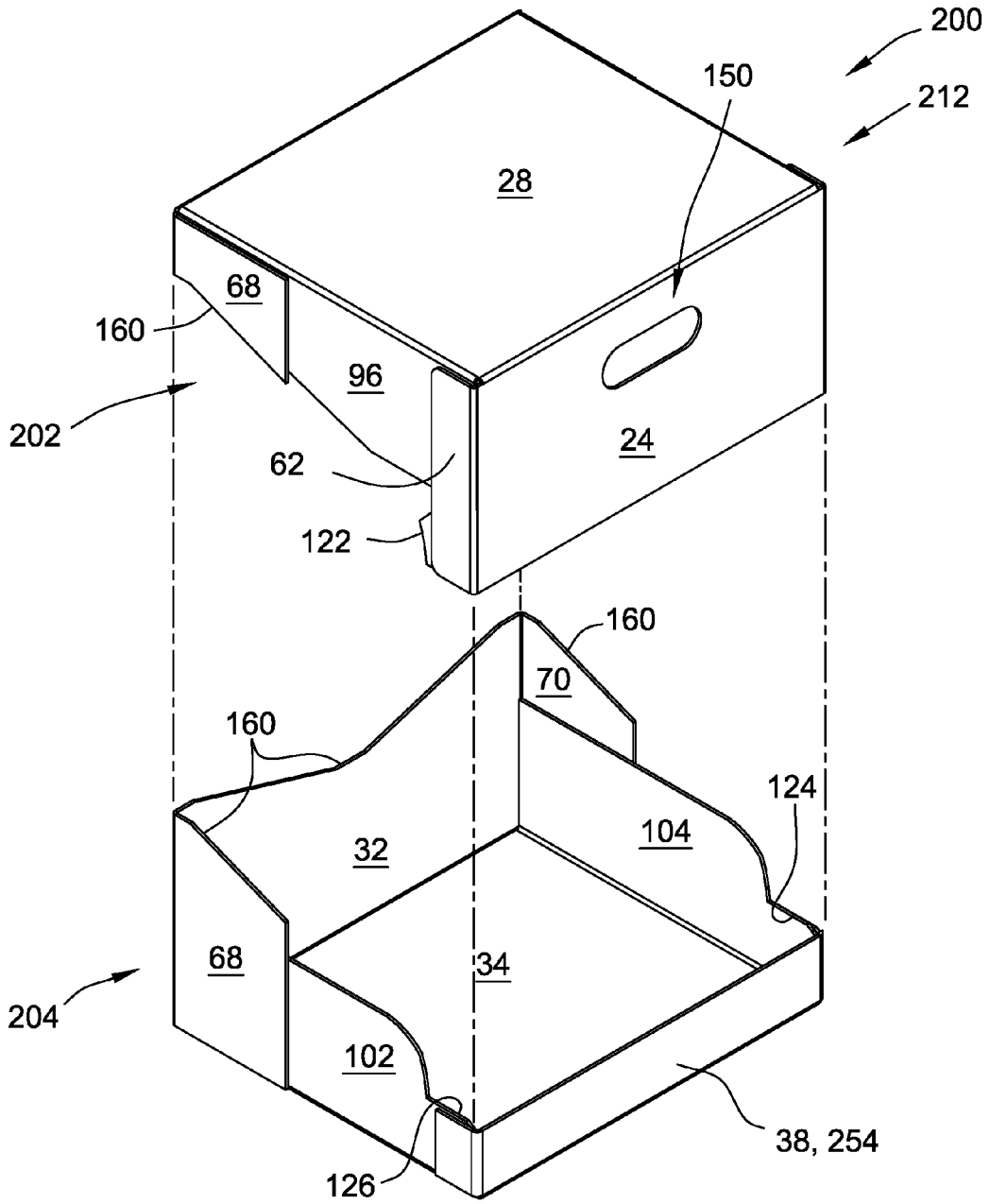
FIG. 4 is a perspective view of the container of FIGS. 2 and 3 in the second orientation with a top portion removed, converting the container into a display configuration.

Referring now to the drawings, and more specifically to FIGS. 1-4, although as described above a container may have any suitable size, shape, and/or configuration, FIG. 1 is a top plan view of an example embodiment of a blank 10 of sheet material, FIG. 2 is a perspective view of a container 200 formed from blank 10 in a closed, shipping configuration 210 in a first orientation, FIG. 3 is a perspective view of container 200 in shipping configuration 210 in a second orientation, and FIG. 4 is a perspective view of container 200 with a top portion 202 removed from a tray portion 204 of container 200, converting container 200 into a display configuration 212.

As shown in FIG. 1, blank 10 has an interior surface 12 and an exterior surface 14. In certain embodiments, portions of exterior surface 14 and/or interior surface 12 of blank 10 include printed graphics, such as advertising and/or promotional materials. Blank 10 includes a series of aligned side panels and end panels connected together by a plurality of preformed, generally parallel, fold lines. Although referred to herein as side panels and end panels, the panels included in blank 10 that are used to form the side walls of the container may be collectively referred to as side panels or side faces.

Specifically the side panels include a first end panel 24, also referred to as a front panel 24, a top panel 28, a second end panel 32, also referred to as a rear panel 32, a bottom panel 34, and a retaining panel 38 connected in series along a plurality of fold lines 44, 48, 52, and 54. It should be understood that designations such as "end," "side," "front," "rear," "top," and "bottom" are used for explanatory purposes only and do not impose orientation requirements on container 200 except as expressly stated herein. First end panel 24 extends from a first free edge 56 of blank 10 to fold line 44, top panel 28 extends from first end panel 24 along fold line 44, second end panel 32 extends from top panel 28 along fold line 48, bottom panel 34 extends from second end panel 32 along fold line 52, and retaining panel 38 extends from bottom panel 34 along fold line 54 to a second free edge 58 of blank 10. Panels 24, 28, 32, and 34 may be referred to as first and second sets of opposing side panels, where panels 24 and 32 are one set and panels 28 and 34 are another set.

A first front side panel 60 and a second front side panel 62 extend from opposing side edges of first end panel 24. More specifically, first front side panel 60 and second front side panel 62 extend from first end panel 24 along a pair of opposing preformed, generally parallel, fold lines 64 and 66 respectively. Similarly, a first rear side panel 68 and a second rear side panel 70 extend from opposing side edges of second end panel 32. More specifically, first rear side panel 68 and second rear side panel 70 extend along a pair of opposing preformed, generally parallel, fold lines 72 and 74, respectively. Fold lines 64, 66, 72, and 74 are generally parallel to each other and generally perpendicular to fold lines 44, 48, 52, and 54.

A first top side panel 94 and a second top side panel 96 extend from opposing side edges of top panel 28. More specifically, first top side panel 94 and second top side panel 96 extend from top panel 28 along a pair of opposing preformed, generally parallel, fold lines 98 and 100, respectively. Similarly, a first bottom side panel 102 and a second bottom side panel 104 extend from opposing side edges of bottom panel 34. More specifically, first bottom side panel 102 and second bottom side panel 104 extend from bottom panel 34 along a pair of opposing preformed, generally parallel, fold lines 106 and 108, respectively. Fold lines 98, 100, 106, and 108 are generally parallel to each other and generally perpendicular to fold lines 44, 48, 52, and 54. First top side panel 94 and second top side panel 96 include notches 75 such that panels 94, 96 have an at least partially trapezoidal shape. In other embodiments, notches 75 are shaped such that panels 94, 96 have any suitable shape, such as, but not limited to, rounded. In still other embodiments, panels 94 and 96 do not include notches 75. In the illustrated embodiment, top panel 28 has a width 110 taken along central horizontal axis 78 of blank 10 that is substantially equal to a width 112 of bottom panel 34, also taken along central horizontal axis 78. Moreover, in the example embodiment, each of first top side panel 94 and second top side panel 96 has a width substantially equal to width 110 of top panel 28, and each of first bottom side panel 102 and second bottom side panel 104 has a width substantially equal to width 112 of rear panel 34. In alternative embodiments, each of panels 28, 34, 94, 96, 102, and 104 has any width that enables blank 10 and a container constructed therefrom to function as described herein.

In the illustrated embodiment, retaining panel 38 has a width 121 taken along central horizontal axis 78 of blank 10, and first end panel 24 has a width 76 also taken along a central horizontal axis 78 of blank 10. In certain embodiments, a sum of width 121 and width 76 is less than or approximately equal to a width 80 of second end panel 32, also taken along central horizontal axis 78 of blank 10, such that panels 24 and 38 cooperate, without overlapping, to form a side wall of container 200 in shipping configuration 210 that has approximately the same width as a side wall formed by panel 32. In alternative embodiments, each of panels 24, 32, 38, 60, 62, 68, and 70 has any width that enables blank 10 and container 200 constructed therefrom to function as described herein.

A first retaining panel tab 114 and a second retaining panel tab 116 extend from opposing side edges of retaining panel 38. More specifically, first retaining panel tab 114 and second retaining panel tab 116 extend from retaining panel 38 along a pair of opposing preformed, generally parallel, fold lines 118 and 120 respectively. Fold lines 118 and 120 are generally parallel to each other and generally perpendicular to fold line 54. In alternative embodiments, each of panels 38, 114, and 116 has any width that enables blank 10 and a container constructed therefrom to function as described herein.

In the example embodiment, each of first bottom side panel 102 and second bottom side panel 104 includes a notch 77 at an edge proximate fold line 54 between bottom panel 34 and retaining panel 38. In the example embodiment, each notch 77 has a rounded shape. In other embodiments, notches 77 are shaped such that panels 102, 104 have any suitable shape, such as, but not limited to, at least partially trapezoidal. In still other embodiments, panels 102 and 104 do not include notches 77.

A first side tab 122 and a second side tab 124 extend from opposing side edges of first bottom side panel 102 and second bottom side panel 104, respectively. More specifically, first side tab 122 and second side tab 124 extend from first bottom side panel 102 and second bottom side panel 104, respectively, along a pair of opposing preformed, generally parallel, fold lines 126 and 128. Fold lines 126 and 128 are generally parallel to each other and generally perpendicular to fold line 54. In the example embodiment, first side tab 122 and second side tab 124 extend from notch 77 of first bottom side panel 102 and second bottom side panel 104, respectively, such that first side tab 122 and second side tab 124 do not extend significantly beyond first bottom side panel 102 and second bottom side panel 104, respectively, in a direction perpendicular to central horizontal axis 78. In alternative embodiments, each of first side tab 122 and second side tab 124 extends to any suitable extent in a direction perpendicular to central horizontal axis 78 that enables container 200 to function as described herein.

Moreover, in the example embodiment, each of first side tab 122, second side tab 124, first side front panel 60, and second side front panel 62 is configured such that first front side panel 60 overlaps second side tab 124 for coupling in a face-to-face relationship, and second front side panel 62 overlaps first side tab 122 for coupling in a face-to-face relationship, when container 200 is formed in shipping configuration 210. For example, each of first side tab 122 and second side tab 124 extends from respective side panel 102 and 104 at a suitable location along central horizontal axis 78, and/or each of first side front panel 60 and second side front panel 62 has a sufficient width taken along central horizontal axis 78, such that first front side panel 60 overlaps second side tab 124 for coupling in a face-to-face relationship, and second front side panel 62 overlaps first side tab 122 for coupling in a face-to-face relationship, when container 200 is formed. In alternative embodiments, each of panels 122, 124, 60, and 62 has any suitable width that enables container 200 to function as described herein.

In the example embodiment, fold lines 126 and 128 are perforated to facilitate a user manually removing a top portion from a tray portion of container 200 constructed from blank 10, as described further herein. In alternative embodiments, any suitable separation mechanism is located along fold lines 126 and 128 that enables a user to separate first side tab 122 and second side tab 124 from first bottom side panel 102 and second bottom side panel 104 respectively. For example, but not by way of limitation, a pull strip or zipper rule is located along fold lines 126 and 128. In alternative embodiments, any plurality of fold lines may be perforated that enable blank 10 and a container constructed therefrom to function as described herein.

In the example embodiment, blank 10 includes a plurality of glue regions 130. Glue regions 130 are regions where glue or other adhesive is applied to strategically couple two or more of panels 24, 28, 32, 34, 38, 60, 62, 68, 70, 94, 96, 102, 104, 114, 116, 122, and 124 when a container is formed from blank 10, as described further herein. In the example embodiment, glue regions 130 are included on panels 60, 62, 68, 70, 114, and 116. More specifically, first glue regions 130 disposed on side panel 60 are configured to couple side panel 60 to side panel 94 and tab 124. Similarly, first glue regions 130 disposed on side panel 62 are configured to couple side panel 62 to side panel 96 and tab 122. Second glue regions 130 disposed on side panel 68 are configured to couple side panel 68 to side panels 96 and 102. Similarly, second glue regions 130 disposed on side panel 70 are configured to couple side panel 70 to side panels 94 and 104. Furthermore, glue regions 130 disposed on tabs 114 and 116 are configured to couple tabs 114 and 116 to side panels 104 and 102 respectively. In alternative embodiments, glue regions 130 are included on any suitable panel that enables top portion 202 to be separated from tray portion 204 of container 200 as described herein. For example, glue regions 130 are disposed on side panels 94 and 104 and are configured to couple side panels 60 and 70 to side panels 94 and 104, respectively. For another example, glue regions 130 are disposed on side panels 96 and 102 and are configured to couple side panels 62 and 68 to side panels 96 and 102, respectively.

In the example embodiment, first end panel 24 includes an access region 150. In the example embodiment, access region 150 is a region or area of weakness that can be punched-out by a user, leaving a cavity or hole in first end panel 24. In alternative embodiments, blank 10 includes access regions 150 in any suitable number, location, and configuration that enables blank 10 to function as described herein. For example, in alternative embodiments, blank 10 includes a plurality of access regions 150 disposed adjacent to one of fold lines 44, 48, 52, and 54 on panels 24, 28, 32, and 34.

In the example embodiment, a line of weakness 160 extends through first rear side panel 68, second end panel 32, and second rear side panel 70. As used herein, the term "line of weakness" refers to any preformed line, such as but not limited to score lines, perforation lines, or lines of separation along which the blank material is configured to have a relatively decreased resistance to tearing, and/or to any other suitable separation mechanism. For example, but not by way of limitation, a pull strip or zipper rule is located along line 160.

More specifically, in the example embodiment, line of weakness 160 extends from a free side edge of first rear side panel 68 across panel 68 to fold line 72, from fold line 72 across second end panel 32 to fold line 74, and from fold line 74 across second rear side panel 70 to a free side edge of panel 70. In the example embodiment, line of weakness 160 is positioned on first rear side panel 68 to substantially align with notch 75 of second top side panel 96, and positioned on second rear side panel 70 to substantially align with notch 75 of first top side panel 94, when container 200 is formed in shipping configuration 210. In alternative embodiments, line of weakness 160 may extend in any combination of linear or accurate segments across panels 32, 68, and 70 in any shape or pattern that enables blank 10 and container 200 constructed therefrom to function as described herein.

In the example embodiment, blank 10 is fabricated from a corrugated cardboard material and includes a plurality of corrugations or flutes (not shown) therein, oriented parallel to a corrugation direction indicated at 190. As described further herein, corrugation direction 190 facilities improved stacking strength for blank 10 when erected into container 200.

Container 200 includes a first end wall 224, a top wall 228, a second end wall 232 opposite first end wall 224, a bottom wall 234 opposite top wall 228, a first side wall 246, and a second side wall 248 opposing first side wall 246. In the example embodiment, each of end walls 224 and 232 is generally perpendicular to each of side walls 246, 248, and each of end walls 224 and 232 and side walls 246, 248 is generally perpendicular to bottom wall 234 and top wall 228, such that container 200 has a generally rectangular shape. In alternative embodiments, end walls 224 and 232, side walls 246 and 248, top wall 228, and bottom wall 234 have any relative orientation that enables container 200 to function as described herein. In further alternative embodiments, container 200 has a generally square shape, or may have more than four side panels and/or side walls. End walls 224 and 232, side walls 246 and 248, top wall 228, and bottom wall 234 cooperate to define cavity 252 of container 200.

In some embodiments, blank 10 may be partially erected into container 200 in a first orientation such that second end wall 232 defines a bottom of container 200, and filled with a product. The partially formed container 200 may then be sealed in shipping configuration 210 in the first orientation, as shown in FIG. 2, such that second end wall 232 continues to define a bottom of container 200 for shipping and/or storage. After receipt at a retail facility, container 200 may be rotated 90 degrees into the second orientation, as shown in FIG. 3, such that bottom wall 234 defines a bottom of container 200, and further converted into display configuration 212 in the second orientation as shown in FIG. 4 for placement on a shelf, where consumers can view and extract product for purchase directly from container 200. In some such embodiments, container 200 has an improved stacking strength in the first orientation, as will be described herein. In alternative embodiments, container 200 is placed in any suitable orientation for any of respectively filling the partially formed container with a product, storing the container, shipping the container, and displaying the display portion of the container.

In the example embodiment, first end wall 224 includes first end panel 24 and retaining panel 38, second end wall 232 includes second end panel 32, top wall 228 includes top panel 28, and bottom wall 234 includes bottom panel 34. Furthermore, first side wall 246 includes second front side panel 62, first rear side panel 68, second top side panel 96, first bottom side panel 102, retaining panel tab 116, and side tab 122. Further still, second side wall 248 includes first front side panel 60, second rear side panel 70, first top side panel 94, second bottom side panel 104, retaining panel tab 114, and side tab 124.

In the example embodiment, the following steps are performed to form container 200 in shipping configuration 210 from blank 10: (1) rotate front panel 24, top panel 28, rear panel 32, bottom panel 34, and retaining panel 38 about parallel fold lines 44, 48, 52, and 54, respectively, such that front panel 24 and rear panel 32 are substantially parallel to each other and substantially orthogonal to top panel 28 and bottom panel 34, and such that retaining panel 38 is in substantially co-planar relationship with front panel 24, to form front wall 224, top wall 228, back wall 232, and bottom wall 234; (2) rotate side panels 60, 94, 70, and 104 into substantially orthogonal relationship to front wall 224, top wall 228, back wall 232, and bottom wall 234 to form side wall 248, such that side panel 60 aligns for coupling to second side tab 124 and for coupling to side panel 94 at respective first glue regions 130, and such that side panel 70 aligns for coupling to side panel 104 and for coupling to side panel 94 at respective second glue regions 130; (3) rotate side panels 62, 96, 68, and 102 into substantially orthogonal relationship to front wall 224, top wall 228, back wall 232, and bottom wall 234 to form side wall 246, such that side panel 62 aligns for coupling to first side tab 122 and for coupling to side panel 96 at respective first glue regions 130, and such that side panel 68 aligns for coupling to side panel 102 and to side panel 96 at respective second glue regions 130; and (4) rotate retaining panel tab 114 into substantially face-to-face contact with side panel 104, and retaining panel tab 116 into substantially face-to-face contact with side panel 102, for coupling at respective third glue regions 130. It should be understood that the steps listed above can be performed in any suitable sequence that enables container 200 to be formed from blank 10.

In certain embodiments, as discussed above, container 200 in shipping configuration 210 is in the first orientation shown in FIG. 2 for shipping and/or storage, such that second end wall 232 defines a bottom of container 200 and first end wall 224 defines a top of container 200. In such an orientation, top panel 28, bottom panel 34, and side panels 94, 96, 102, and 104 each extend from the bottom to the top of container 200 and are oriented with corrugation direction 190 in a vertical direction, facilitating an improved stacking strength of container 200. In addition, in some such embodiments, side panels 94, 96, 102, and 104 are positioned interiorly with respect to side panels 60, 62, 68, and 70, such that side panels 94, 96, 102, and 104 are at least partially protected from external damage and are positioned to directly bear weight placed on the top of container 200 and transmit the weight directly to the bottom of container 200, again facilitating an improved stacking strength of container 200. Moreover, in some embodiments, side panels 62 and 60 having portions coupled to side tabs 122 and 124, respectively, facilitates at least one of forming the container in the shipping configuration by a high-speed machine, improved enclosure of cavity 252, and/or improved stability of container 200 in shipping configuration 210.

In the example embodiment, the following steps are performed to convert container 200 from shipping configuration 210 to display configuration 212: (1) separate side tabs 122 and 124 from side panels 102 and 104, respectively, along perforation lines 126 and 128, respectively; (2) pull top portion 202 up and back from display portion 204, for example by gripping access region 150, such that top portion 202 separates from tray portion 204 along line of weakness 160. As described above, side panels 94 and 96 emanate from top panel 28; side panels 60 and 62 emanate from front panel 24 and are glued to side panels 94 and 96, respectively, and to side tabs 124 and 122, respectively; and portions of side panels 68 and 70 above line of weakness 160 are glued to side panels 96 and 94, respectively. Therefore, side panels 60, 62, 94, and 96 having side tabs 122 and 124 and portions of side panels 68 and 70 above line of weakness 160 glued thereto, separate from side walls 246 and 248 without interference. Panels 24, 28, 60, 62, 94, and 96, side tabs 122, 124, and respective portions of panels 32, 68, and 70 above line of weakness 160, define removable top portion 202 of container 200. Similarly, side panels 102 and 104 emanate from bottom panel 34 and side panels 68 and 70 emanate from rear panel 32 and are glued to side panels 102 and 104, respectively, below line of weakness 160, such that side panels 102 and 104 and portions of side panels 68 and 70 below line of weakness 160 remain with bottom panel 34 and a portion of rear panel 32 below line of weakness 160 to form display portion 204. In addition, retaining panel 38 forms a front display wall 254 of display portion 204, and retaining panel tabs 114 and 116 coupled to side panels 104 and 102, respectively, remain with display portion 204.

Figure 5:
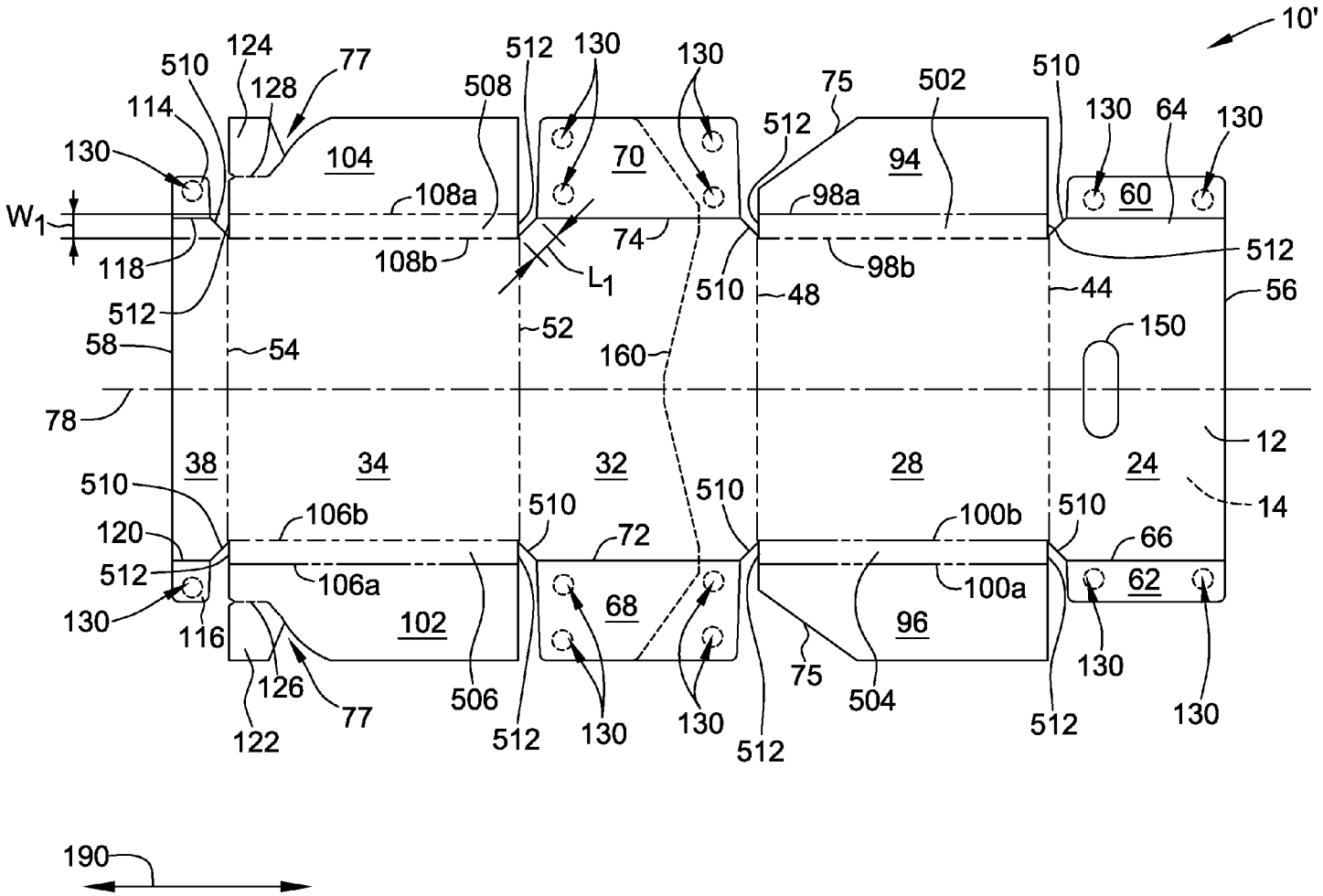
FIG. 5 is a top plan view of another example embodiment of a blank of sheet material.
Figure 6:
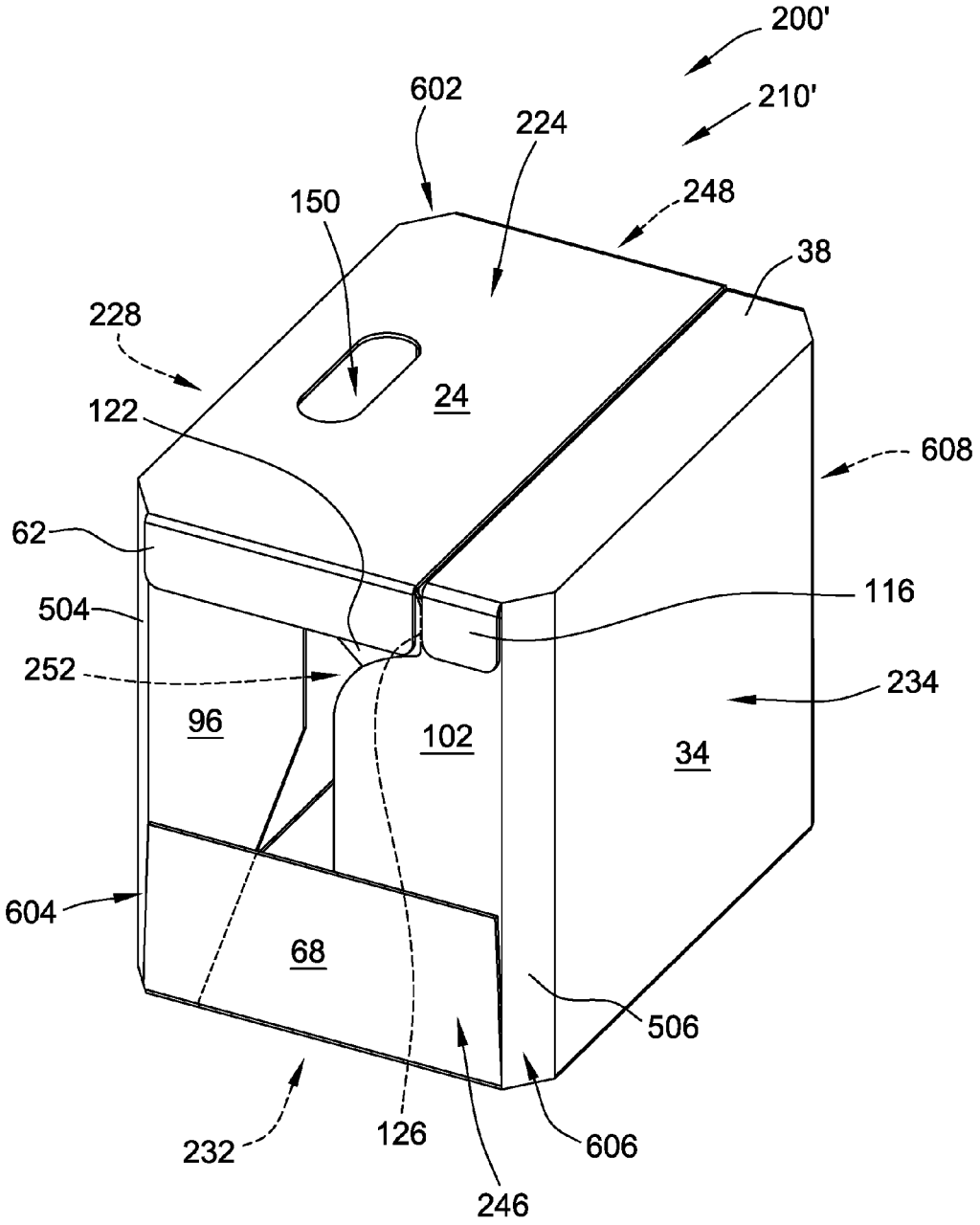
FIG. 6 is a perspective view of an example container formed from the blank shown in FIG. 5 in a closed, shipping configuration in a first orientation.

FIG. 5 is a top plan view of another example embodiment of a blank 10' of sheet material. FIG. 6 is a perspective view of a container 200' formed from blank 10' in a closed, shipping configuration 210' in a first orientation. Blank 10' is similar to blank 10 (shown in FIG. 1) except as otherwise described herein. More specifically, blank 10' is configured to form container 200' having eight sides in the first orientation.

Similar to blank 10, blank 10' includes front panel 24, top panel 28, back panel 32, bottom panel 34, and retaining panel 38 connected in series along parallel fold lines 44, 48, 52, and 54, front side panels 60 and 62 extending from opposing side edges of front panel 24, rear side panels 68 and 70 extending from opposing side edges of rear panel 32, and retaining panel tabs 114 and 116 extending from opposing side edges of retaining panel 38. Also similar to blank 10, blank 10' includes line of weakness 160 extending through first rear side panel 68, second end panel 32, and second rear side panel 70, and includes side tabs 122 and 124 extending from bottom side panels 102 and 104 along perforated fold lines 126 and 128.

Unlike blank 10, however, top panel 28 includes first and second top corner panels 502 and 504 extending from opposing side edges of top panel 28 along a pair of opposing preformed, generally parallel, fold lines 98*b* and 100*b*, respectively. Top side panel 94 extends from a side edge of first top corner panel 502, and top side panel 96 extends from a side edge of second top corner panel 504, along a pair of opposing preformed, generally parallel, fold lines 98*a* and 100*a*, respectively. Similarly, bottom panel 34 includes first and second bottom corner panels 506 and 508 extending from opposing side edges of bottom panel 34 along a pair of opposing preformed, generally parallel, fold lines 106*b* and 108*b*, respectively. Bottom side panel 102 extends from a side edge of first bottom corner panel 506, and bottom side panel 104 extends from a side edge of second bottom corner panel 508, along a pair of opposing preformed, generally parallel, fold lines 106*a* and 108*a*, respectively. Fold lines 98*a*, 98*b*, 100*a*, 100*b*, 106*a*, 106*b*, 108*a*, and 108*b* are generally orthogonal to fold lines 44, 48, 52, and 54.

Also unlike blank 10, each of four corners of rear panel 32 of blank 10' includes a mitered edge 510. Similarly, each of two corners of front panel 24 proximate fold line 44 and two corners of retaining panel 38 proximate fold line 54 includes mitered edge 510. In the example embodiment, a length $L_1$ of each mitered edge 510 is equal to a width $W_1$, measured in a direction perpendicular to central horizontal axis 78, of each of corner panels 502, 504, 506, and 508. In the example embodiment, each of corner panels 502, 504, 506, and 508 extends in a direction parallel to central horizontal axis 78 between a respective pair of free edges 512, and pair of free edges 512 of each corner panel 502, 504, 506, and 508 is configured to align with a respective pair of mitered edges 510 when container 200' is formed in shipping configuration 210'. In alternative embodiments, corner panels 502, 504, 506, and 508 and mitered edges 510 has any suitable width, length, and configuration that enables container 200' to function as described herein.

Similar to container 200, container 200' includes opposing end walls 224 and 232, opposing top and bottom walls 228 and 234, and opposing side walls 246 and 248. Unlike container 200, container 200' also includes a first top corner wall 602 extending between top wall 228 and second side wall 248, a second top corner wall 604 extending between top wall 228 and first side wall 246, a first bottom corner wall 606 extending between bottom wall 234 and first side wall 246, and a second bottom corner wall 608 extending between bottom wall 234 and second side wall 248. In the example embodiment, corner walls 602 and 606 are generally parallel to each other and generally orthogonal to corner wall 604 and 608, and each corner wall 602, 604, 606, and 608 is disposed at an acute angle relative to each of top and bottom walls 228 and 234 and side walls 246 and 248. In alternative embodiments, each corner wall 602, 604, 606, and 608 is disposed at any suitable orientation that enables container 200' to function as described herein.

Container 200' is formed from blank 10' in substantially similar fashion as described above for forming container 200 from blank 10, with the additional step that corner panels 502, 504, 506, and 508 are rotated about respective fold lines 98*b*, 100*b*, 106*b*, and 108*b* to form corner walls 602, 604, 606, and 608. Moreover, container 200' is convertible to a display configuration (not shown) in the second orientation in the same fashion as container 200 is converted to display configuration 212, as shown in FIGS. 3 and 4. In certain embodiments, in addition or alternatively to one or more features of container 200 that yield improved stacking strength as discussed above, corner walls 602, 604, 606, and 608 further increase a stacking strength and stability of container 200' in the first orientation.

The above-described embodiments provide containers convertible from a shipping configuration to a display configuration. In the display configuration, consumer viewing and access is unobstructed. In the shipping configuration, the container may be oriented such that a face of each panel used to form two sets of opposing side walls is devoid of perforation lines or other lines of weakness extending therethrough, such that a stacking strength of the container is improved. In some embodiments, the container is easily convertible from the shipping configuration to the display configuration by rotating to a second orientation, detaching two side tabs along perforations, and separating along a line of weakness along a rear panel and two sides panels.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the example embodiments can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a container convertible from a shipping configuration to a display configuration, the blank comprising:

a front panel, a top panel, a rear panel, and a bottom panel coupled together in series by a plurality of generally parallel fold lines;

a pair of front side panels extending from opposing side edges of said front panel;

a pair of top side panels coupled to opposing side edges of said top panel; and a pair of bottom side panels coupled to opposing side edges of said bottom panel, wherein a respective side tab extends directly from each said bottom side panel along a respective tab perforation line, each said side tab is configured to couple to one of said front side panels in a face-to-face relationship when the container is formed, and wherein a face of each of said top panel, said bottom panel, said pair of top side panels, and said pair of bottom side panels is devoid of perforation lines extending therethrough; and further comprising a pair of rear side panels extending from opposing edges of said rear panel;

wherein a line of weakness extends through said rear panel and said pair of rear side panels, and wherein said front panel, said top panel, said pair of front side panels, and said pair of top side panels are configured to be secured to said bottom panel and said pair of bottom side panels solely along said line of weakness and said tab perforation lines when the container is formed.

2. The blank in accordance with claim 1, further comprising a retaining panel coupled in series to said bottom panel, said retaining panel configured to align with said front panel in a substantially co-planar relationship when the container is formed.

3. The blank in accordance with claim 1, wherein each said side tab extends from a notch defined in said respective bottom side panel.

4. The blank in accordance with claim 1, wherein each of said pair of front side panels is configured to couple to one of said pair of top side panels and to one of said pair of side tabs at respective first glue regions, and each of said pair of rear side panels is configured to couple to one of said pair of bottom side panels and to one of said pair of top side panels at respective second glue regions, when the container is formed.

5. The blank in accordance with claim 1, further comprising:

a pair of top corner panels, each of said top corner panels extending between said top panel and one of said top side panels; and a pair of bottom corner panels, each of said bottom corner panels extending between said bottom panel and one of said bottom side panels, each of said corner panels configured to form a respective corner wall of the container when the container is formed.

6. The blank in accordance with claim 5, wherein:

each said corner panel extends between a respective pair of free edges, said rear panel comprises a mitered edge at each of four corners of said rear panel, and one of said pair of free edges of each said corner panel is configured to align with a respective one of said mitered edges of said rear panel when the container is formed.

7. A container convertible from a shipping configuration to a display configuration, said container formed from a blank, said container comprising:

opposing front and rear walls, and opposing top and bottom walls perpendicular to said opposing front and rear walls; and a pair of opposing side walls orthogonal to said front and rear walls and said top and bottom walls, each of said side walls comprising a front side panel emanating from said front wall, a top side panel emanating at least indirectly from said top wall, a bottom side panel emanating at least indirectly from said bottom wall, and a side tab emanating directly from said bottom side panel along a tab perforation line, said side tab coupled in a face-to-face relationship with said front side panel, wherein a face of each of said top wall, said bottom wall, said top side panels, and said bottom side panels is devoid of perforation lines extending therethrough;

wherein each said side wall further comprises a rear side panel emanating from said rear wall;

wherein a line of weakness extends through said rear wall and said rear side panel of each said side wall, wherein said front wall comprises a front panel emanating from said top wall, and wherein said front panel, said top wall, said front side panel of each said side wall, and said top side panel of each said side wall are secured to said bottom wall, and said bottom side panel of each said side wall solely along said line of weakness and said tab perforation line of each said side wall.

8. The container in accordance with claim 7, wherein said front wall comprises a front panel emanating from said top wall and a retaining panel emanating from said bottom wall, said retaining panel aligned with said front panel in a substantially co-planar relationship.

9. The container in accordance with claim 7, wherein said side tab extends from a notch defined in said bottom side panel.

10. The container in accordance with claim 7, wherein said front side panel is coupled to said top side panel and to said side tab at respective first glue regions, and said rear side panel is coupled to said bottom side panel and to said top side panel at respective second glue regions.

11. The container in accordance with claim 7, further comprising:

a pair of top corner walls, each of said top corner walls extending between said top wall and one of said side walls; and a pair of bottom corner walls, each of said bottom corner walls extending between said bottom wall and one of said side walls.

12. The container in accordance with claim 11, wherein:

each said corner wall comprises a corner panel that extends between a respective pair of free edges, said rear wall comprises a mitered edge at each of four corners of said rear wall, and one of said pair of free edges of each said corner panel is aligned with a respective one of said mitered edges of said rear wall.

* * * * *